United States Patent [19]

Lawson et al.

[11] Patent Number: 4,781,327

[45] Date of Patent: Nov. 1, 1988

[54] DYNAMIC PROTECTIVE SHIELD FOR POP-UP SPRINKLERS

[75] Inventors: Kenneth L. Lawson, Ontario; Enric C. Mendoza, Walnut; Edward M. Troup, deceased, late of Mount Baldy, all of Calif., by Cathryn H. Troup, legal representative

[73] Assignee: Anthony Manufacturing Corporation, Calif.

[21] Appl. No.: 61,159

[22] Filed: Jun. 12, 1987

[51] Int. Cl.[4] ..... B05B 15/10; B05B 1/28

[52] U.S. Cl. ..... 239/203; 239/205; 239/206; 239/288.3; 239/288.5

[58] Field of Search ..... 239/104, 106, 114, 115, 239/123, 203–206, 288, 288.3, 288.5, 456, 459, 264

[56] References Cited

U.S. PATENT DOCUMENTS

| | | | |
|---|---|---|---|
| 2,080,341 | 5/1937 | Schumacher . | |
| 2,878,062 | 3/1959 | Crow | 239/264 X |
| 3,015,448 | 1/1962 | Hurless | 239/288.5 X |
| 3,035,778 | 5/1962 | Kimbro et al. | 239/204 X |
| 3,258,205 | 6/1966 | Hruby, Jr. | 239/204 |
| 3,282,508 | 11/1966 | Roberts | 239/204 |
| 3,655,132 | 4/1972 | Rosic | 239/206 |
| 3,762,642 | 10/1973 | Di Santo | 239/288.5 X |
| 3,955,764 | 5/1976 | Phaup | 239/206 |
| 4,108,439 | 8/1978 | McGuire | 239/201 |
| 4,145,003 | 3/1979 | Harrison et al. | 239/288 |
| 4,212,426 | 7/1980 | Choi | 239/288.5 X |
| 4,316,579 | 2/1982 | Ray et al. | 239/123 |
| 4,429,832 | 2/1984 | Sheets | 239/204 |

FOREIGN PATENT DOCUMENTS

| | | | |
|---|---|---|---|
| 488251 | 11/1952 | Canada | 239/204 |

*Primary Examiner*—Andres Kashnikow
*Assistant Examiner*—Mary Beth O. Jones
*Attorney, Agent, or Firm*—Kelly, Bauersfeld & Lowry

[57] ABSTRACT

A pop-up guard or shield for use with a pop-up sprinkler mounted in a casing buried in the ground to protect against the entry of dirt, sand, weeds, and the like into the casing during sprinkler operation. The guard includes a spring biased sleeve which pops up together with the sprinkler during sprinkler extension to the operative position, and is retracted into the casing during movement of the sprinkler to the inoperative position.

13 Claims, 3 Drawing Sheets

DYNAMIC PROTECTIVE SHIELD FOR POP-UP SPRINKLERS

BACKGROUND OF THE INVENTION

This invention relates to pop-up irrigation sprinklers of the type contained within a casing buried in the ground, and more particularly to a new and improved pop-up guard or shield for preventing dirt, grit, weeds, sand, grass and the like from entering the housing during operation of the sprinkler.

There are many applications for pop-up sprinklers wherein the sprinkler is contained within a casing buried in the ground and which pops up to a position above the casing during operation. Typically, the sprinkler casing is buried in the ground so that its top surface is substantially flush with the ground level, and the sprinkler is spring-biased to the inoperative position retracted inside the casing. A cover is typically attached to the sprinkler and overlies the top of the casing when the sprinkler is in the inoperative position. During irrigation, water is supplied to the sprinkler through the bottom of the casing and the sprinkler extends to the operative position by popping up out of the casing to a position above the ground, the sprinkler carrying the cover with it during its movement to the extended, operative position. Exemplary of sprinklers of this type are those marketed by Rain Bird Sprinkler Mfg. Corp. of Glendora, Calif., under its trademarks "Mini Paw" and "Pop-A-Way" as shown at pages 32 and 33 of the Rain Bird 1986 Turf Irrigation Equipment Catalogue.

Pop-up sprinklers of the general type herein involved are widely used in connection with lawns, golf courses, parks, and other installations where it is undesirable to have a permanently-mounted sprinkler projecting above the ground when not in use. One problem that has long been encountered in the use of such pop-up sprinklers is that of dirt, sand, weeds, grass, and other deleterious particulate matter entering the open top of the sprinkler casing during sprinkler operation and which can cause the sprinkler to jam such that it either does not pop up all the way to the operative position, or does not fully retract into the casing after use. This problem has been particularly noticeable where pop-up sprinklers are used in sandy and gravel-concentrated soils.

While attempts have heretofore been made at solving this problem, none has proved completely satisfactory. Exemplary of such prior art attempts are the use of static shields and guards which are placed around the sprinkler casing to form a plate-like area or well surrounding the sprinkler such as shown and described in U.S. Pat. Nos. 3,762,642 and 4,108,439. Although such prior art devices have met with some success, they still do not prevent deleterious particulate matter on the ground from falling or being backwashed into the open-topped casing during sprinkler operation, particularly during extension and retraction of the sprinkler relative to the casing.

Thus, there exists a need for a reliable and effective shield or guard to prevent deleterious particulate matter from entering the sprinkler casing during sprinkler operation. The present invention satisfies this need.

SUMMARY OF THE PRESENT INVENTION

The present invention provides a dynamic pop-up shield or guard which reliably and effectively protects the sprinkler casing against the entry of dirt, grit, weeds, grass, and other particulate matter which could jam the sprinkler and prevent proper operation. Moreover, the pop-up guard of the present invention is relatively simple in structure and operation, and is inexpensive to manufacture yet substantially enhances reliability of overall sprinkler operation, particularly in sandy and rock-concentrated soils which have heretofore typically posed serious dirt and grit problems for pop-up sprinkler devices.

The pop-up guard comprises an open-ended sleeve slidably disposed within the sprinkler casing for extension and retraction during extension and retraction of the sprinkler. The sleeve is spring-biased toward the extended position, and is dimensioned to have a pop-up height somewhat less than the total pop-up height of the sprinkler so that the sprinkler is free to eject its water stream outwardly above the upper end of the sleeve when in the operative position.

The sleeve is dimensioned to surround the sprinkler when in the inoperative position, and is engageable by the cover attached to the sprinkler which operates to pull the sleeve into the casing as the sprinkler retracts from the operative to the inoperative position. On initiation of an irrigation cycle, as the sprinkler pops up to the operative position, the sleeve extends with the cover until it reaches the fully extended position at which point the cover and sprinkler continue to extend above the sleeve to the operative position.

In accordance with another feature of the present invention, the seal formed of open-cell foam material surrounds the sleeve to seal between the sleeve and housing. The open-cell foam material is sufficiently compliant to effectively absorb any dirt or grit particles that might become lodged between the seal and the sleeve so that the sleeve cannot jam in the extended or retracted position. Other features and advantages of the present invention will become more apparent from the following detailed description taken in conjunction with the accompanying drawings which illustrate, by way of example, the principles of the present invention.

DETAILED DESCRIPTION

Figure 1:
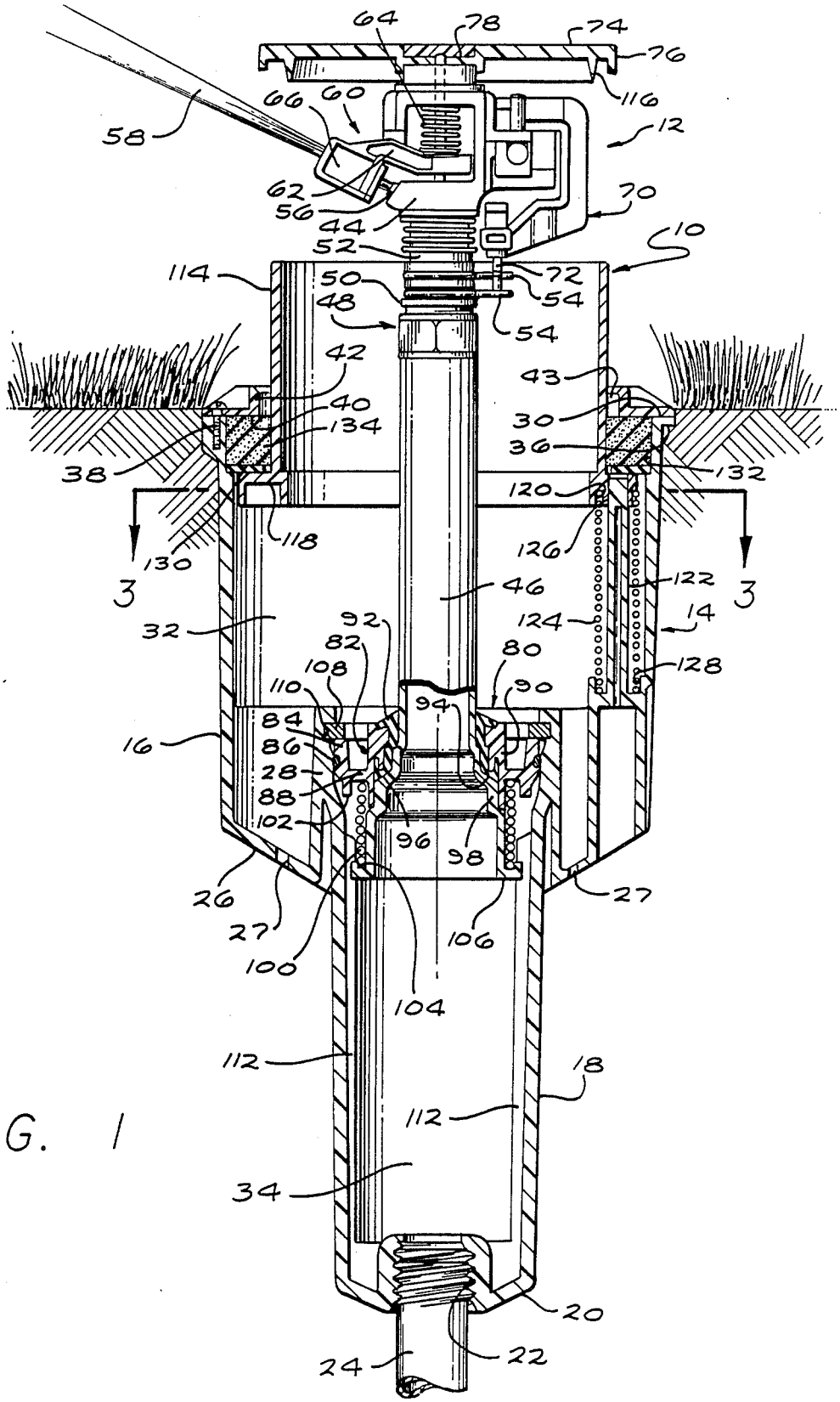
FIG. 1 is a side cross-sectional view of a pop-up sprinkler employing a pop-up guard embodying the principles of the present invention, and showing the sprinkler and guard in their extended, operative positions.

As shown in the exemplary drawings, the present invention is embodied in a pop-up shield or guard 10 for use with an irrigation sprinkler 12 of the type mounted in a casing 14 for movement between an extended, operative position, and a retracted inoperative position. Typically the casing 14 will be disposed in the ground to extend substantially below ground level so that when the sprinkler 12 is in its retracted, inoperative position, the sprinkler is fully contained within the casing and below the ground.

In this instance, the casing 14 is generally cup-shaped and circular in horizontal cross-section, and has an upper cylindrical wall section 16 of relatively large diameter, and a lower, downwardly extended wall section 18 of smaller diameter, the lower section having a closed bottom wall 20 through which centrally extends a threaded opening 22 for coupling the casing 14 to a supply pipe 24 for admitting pressurized water into the casing.

Figure 2:
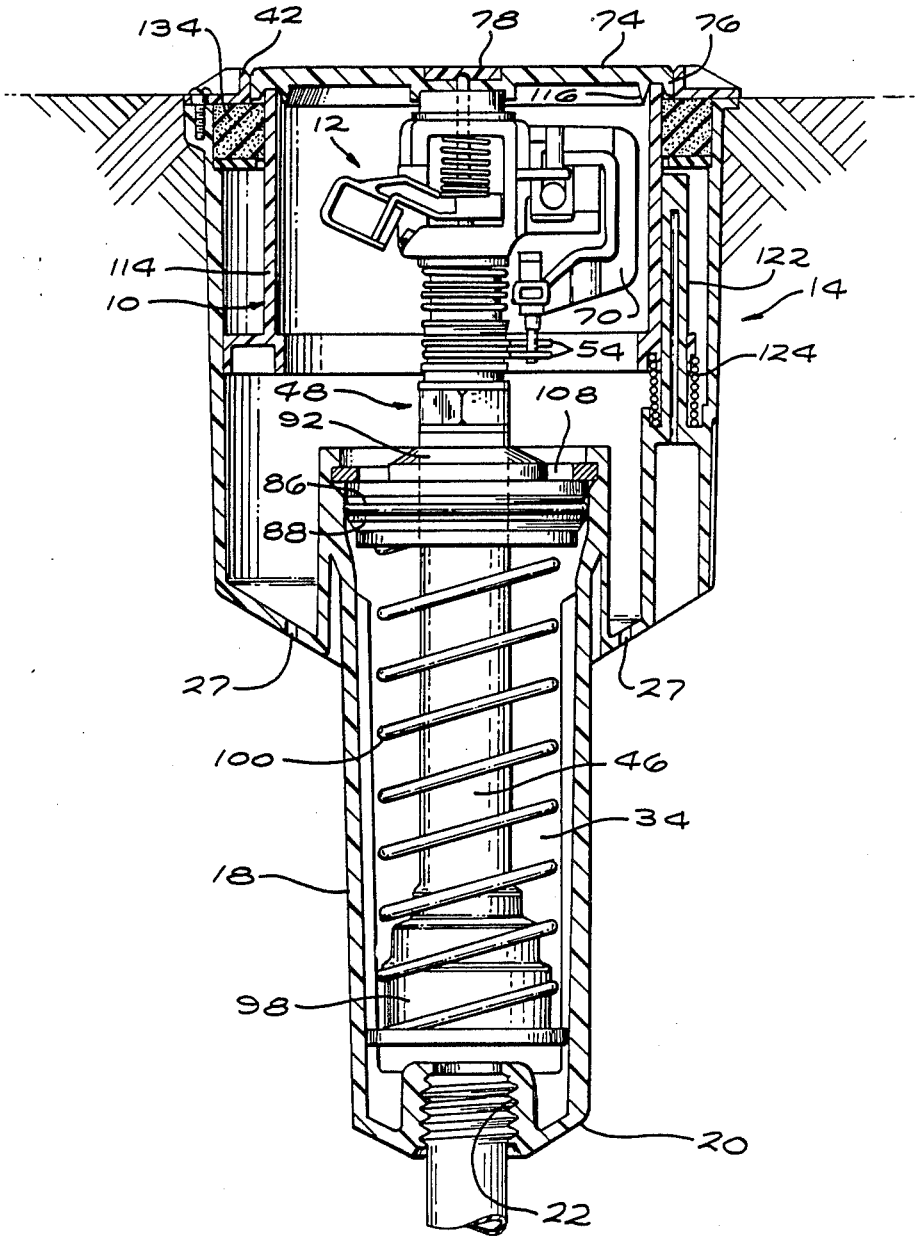
FIG. 2 is a cross-sectional view similar to FIG. 1, but showing the pop-up sprinkler and guard in their retracted, inoperative positions.
Figure 3:
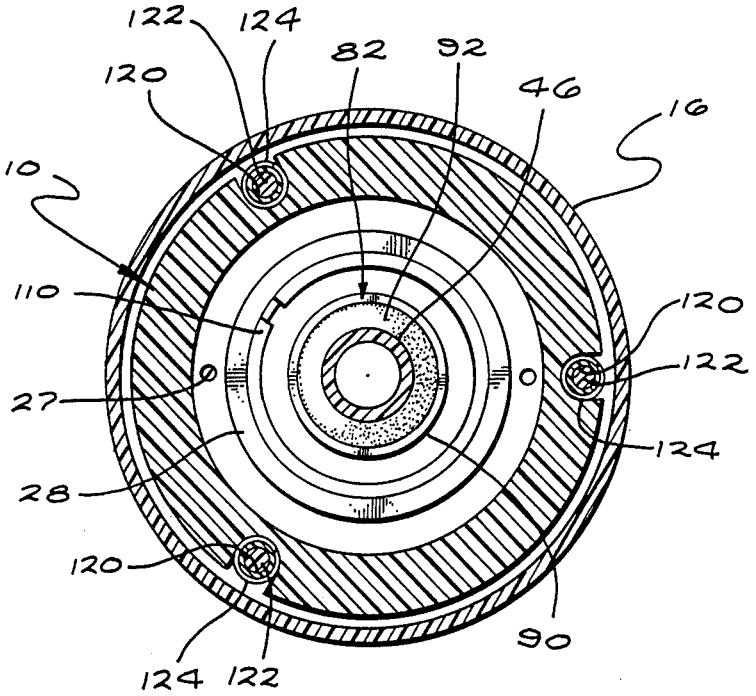
FIG. 3 is a horizontal sectional view taken substantially along the line 3—3 of FIG. 1.

The upper wall section 16 of the casing 14 is dimensioned to have a diameter sufficiently large to permit the casing to fully enclose the sprinkler 12 when in the retracted position, as seen in FIG. 2, and is joined to the lower wall section 18 by a downwardly and inwardly directed bottom wall 26 terminating inwardly in an upwardly directed, relatively short cylindrical wall 28 with which merges the upper end portion of the lower cylindrical wall 18. Drain holes 27 are provided through the bottom wall 26 to permit any water within the casing 14 to escape. Preferably, the upper and lower cylindrical walls 16 and 18, the bottom walls 20 and 26, and the short cylindrical wall 28 are all integrally formed from molded plastic or the like so as to produce a single piece casing 14 having an open upper end 30 opening to a relatively large diameter upper cylindrical chamber 32 and a lower, smaller diameter cylindrical chamber 34.

The open upper end 30 of the casing 14 is formed with a radially outwardly extending annular flange 36 to which is secured in overlying relation herein by screws 38, an annular donut-shaped ring 40 having a radially inner upwardly projecting wall section 42 defining a central opening 43 to the upper chamber 32. As shown in FIGS. 1 and 2, preferably the casing 14 is recessed into the ground such that the ring 40 is approximately level with the ground surface with the wall section 42 projecting slightly thereabove.

The sprinkler 12 herein illustrated is a generally conventional part-circle impact drive type sprinkler such as sold by Rain Bird Sprinkler Mfg. Corp. of Glendora, Calif., and includes a body 44 mounted for rotation to the upper end portion of a tubular stem 46 supported for reciprocating movement within the casing 14. The body 44 is coupled to the stem 46 by a generally conventional nipple assembly including a sleeve 50 threadably attached to the upper end of the stem, and through which extends a tubular nipple 52 attached to the body and journaled for relatively free rotation within the sleeve. Coupled about the sleeve 50 and projecting radially outwardly therefrom are a pair of adjustable trip stops 54 for controlling the arc of sprinkler rotation relative to the stem 46.

Pressurized water admitted to the lower chamber 34 of the casing 14 from the supply pipe 24 travels through the stem 46 and nipple 52 into the sprinkler body 44 where it is ejected by a nozzle 56 outwardly from the sprinkler 12 as a water stream 58. To drive the sprinkler 12, an impact drive arm assembly 60 is coupled to the body 44 and includes a drive arm 62 mounted for rotation about a centrally disposed pivot pin 64 attached to and projecting upwardly from the body, and having a drive spoon 66 formed at one end thereof. A spring 68 coupled between the body 44 and the drive arm 62 about the pivot pin 64 normally urges the drive spoon 66 toward the stream 58 to intercept the stream and effect rotation of the body about a longitudinal axis through the stem 46 in a manner well understood by those skilled in the irrigation sprinkler art.

Coupled to the body 44 opposite the nozzle 56 is a trip assembly 70 having a downwardly projecting trip arm 72 for intercepting the trip stops 54 to effect a reversal of the direction of rotation of the sprinkler 12 during part circle operation.

Disposed above and in overlying relation to the sprinkler 12 is a disc-shaped cover 74 having a downwardly projecting peripheral flange 76 and attached to the sprinkler body 44 by the pivot pin 64 which projects upwardly and centrally through the cover and attached thereto by a cap 78. As best seen in FIG. 2, when the sprinkler 12 is in the retracted, inoperative position, the peripheral flange 76 of the cover 74 is slidably disposed inside the wall 42 of the ring 40 so that the cover 74 substantially closes the opening 43 to the upper chamber 32.

The stem 46 is supported by reciprocation within the casing 14 by a bearing guide and seal assembly 80 mounted to the casing adjacent the juncture of the upper and lower chambers 32 and 34, respectively, within the short wall 28. The guide and seal assembly 80 herein includes a bearing guide 82 of generally U-shaped cross-section and having an outer cylindrical side 84 abutting the inner surface of the short cylindrical wall 28. Preferably, an O-ring seal 86 is disposed in a groove formed in the outer cylindrical side 84 to form a water tight seal between the bearing guide 82 and the short wall 28 of the casing 14.

A bottom 88 couples the outer cylindrical side 84 of the bearing guide 82 with an inner side wall 90 which is contoured to support an annular bearing seal 92 disposed about the inner periphery of the bearing guide. The seal 92 tightly but slidably surrounds the stem 46, and includes a truncated cone-shaped end face 94 engageable by a corresponding flanged surface 96 formed by a step-shaped, enlarged diameter portion 98 of the riser 46 adjacent the lower end. When the stem 46 is in the fully extended position as shown in FIG. 1, the flange surface 96 abuts the end face 94 of the seal 92 to provide a water-tight static seal between the outer surface of the stem and the bearing guide 82. Thus, water entering the lower chamber 34 through the supply pipe 24 is sealed from entry into the upper chamber 32 by the O-ring seal 86 and static seal formed by the end face 94 of the seal 92.

Disposed between the lower end of the bottom 88 of the bearing guide 82, and the lower end of the stem 46 is a retraction spring 100 which operates to retract the stem 46 and sprinkler 12 into the casing 14 when the water pressure admitted to the chamber 34 through the supply pipe 24 drops below a level sufficient to overcome the force of the retraction spring. In this instance, the upper end of the retraction spring 100 is supported in a downwardly opening groove 102 formed in the bottom 88 of the bearing guide 82, and the lower end is supported in an upwardly facing groove 104 formed in an enlarged diameter flange 106 projecting peripherally about the lower end of the stem 46. To retain the bearing guide and seal assembly 80 in position, a snap ring 108 is retained in an inwardly opening peripheral groove 110 formed adjacent the upper end of the short wall section 28 of the casing 14 and which overlies and abuts the upper end of the outer cylindrical side 84 of the bearing guide 82.

To guide the stem 46 within the casing 14 during movement between the extended and retracted positions, a plurality of key way slots are formed through the flange 106 at the bottom of the stem, and through which extend internal ribs 112 formed along the length of the inside of the lower cylindrical wall section 18. During movement of the stem 46 between the extended and retracted positions, the key ways and ribs 112 prevent the stem from rotation relative to the casing 14 and retain the stem in a fixed rotary position during use.

In operation, with the sprinkler 12 and stem 46 disposed in the inoperative retracted position within the casing 14 as seen in FIG. 2, when pressurized water is admitted through the supply pipe 24, the water flows through the stem 46 into a fluid passageway through the sprinkler body 44 and exerts an upward force on the stem and sprinkler sufficient to overcome the force of the retraction spring 100, thereby causing the stem and sprinkler to extend to the operative position shown in FIG. 1 and compress the retraction spring. Upon completion of the irrigation cycle, when water pressure admitted through the supply pipe 24 is reduced sufficiently to permit the compressed retraction spring 100 to overcome the upwardly directly water force on the stem 46 and sprinkler 12, the retraction spring will retract the stem and sprinkler into the casing and back to the inoperative position.

In accordance with the present invention, the pop-up guard 10 cooperates with the casing 14 and the cover 74 attached to the sprinkler 12 to reliably and effectively protect the upper chamber 32 against dirt, grit, weeds, and other particulate matter which could enter the upper end opening 43 and jam the stem 46 during sprinkler operation. Moreover, the pop-up guard 10 is relatively simple in structure and operation, and is inexpensive to manufacture yet substantially enhances reliability of overall sprinkler operation, particularly in sand and rock concentrated soils which have typically posed serious dirt and grit problems for pop-up sprinkler devices.

Toward the foregoing ends, the pop-up guard 10 comprises an open ended sleeve 114 of generally circular horizontal cross-section having an inside diameter slightly larger than the overall diameter of the sprinkler body 44, drive arm assembly 60 and trip assembly 70, and is slidably disposed within the casing 14 for extention and retraction during extention and retraction of the stem 46. Preferably, the outer diameter of the sleeve 114 is slightly less than the inner diameter of the peripheral flange 76 of the cover 74 and the cover includes a downwardly projecting lip 116 disposed about the underside of the cover and which is adapted to guide and center the cover over the open upper end of the sleeve during retraction of the sprinkler 12 and stem 46 to the inoperative position within the casing 14. The sleeve 114 is dimensioned in length so that when fully extended, the upper end is below the sprinkler nozzle 56, thereby permitting the sprinkler 12 to freely operate to eject its stream 58 outwardly above the sleeve.

To mount the sleeve 114 within the casing 14, the lower end portion of the sleeve is formed with an enlarged diameter peripheral flange 118 dimensioned to be received within the upper cylindrical wall section 16 and which herein includes three through-holes 120 equally spaced 120 degrees apart about the flange and through which project guide rods 122 spaced inwardly from the upper cylindrical side wall 16 and projecting upwardly therealong from the lower wall 26.

Disposed about each guide rod 122 is a pop-up spring, the upper end of which is received within a downwardly opening recess 126 formed on the underside of the flange 118, and the lower end of which is received in an upwardly opening recess 128 formed adjacent the lower end of the guide rod. To limit upward movement of the sleeve 114 within the casing 14, a stop ring 130 is mounted to project radially inwardly from an enlarged diameter recess 132 formed in the upper end portion of the upper cylindrical wall 16. Disposed above the stop ring 130 is a donut-shaped wiper seal 134, preferably made of open-cell plastic foam material, and which extends between the stop ring and the underside of the ring 40 secured to the top of the casing 14. The open-cell material of the seal 134 protects against the entry of dirt and grit into the housing 14 between the sleeve 114 and the ring 40, and is compliant to permit any dirt or grit that may become trapped between the sleeve and seal to become embedded in the cells of the seal thereby to permit the sleeve to continue to operate and not become jammed or stuck in one position.

In operation, as the sprinkler 12 and stem 46 extend to the operative position under the action of water pressure from the supply pipe 24, the sleeve 114 extends above the housing 14 with its upper end abutting against the underside of the cover 74 due to the bias of the pop-up springs 124 until the flange 118 engages the stop ring 130. At this point, the sleeve 114 is fully extended and the cover 74 disengages from the sleeve and continues to extend with the sprinkler 12 to the operative positions. Thus, during extension of the sleeve 114, the sprinkler 12 remains substantially fully encased within the sleeve and cover 74, thereby to prevent any dirt or grit from entering into the casing 14. Thereafter, the sprinkler 12 and stem 46 continue to rise so that the sprinkler is above the upper end of the sleeve 114 and free to eject the water stream 58 outwardly as shown in FIG. 1.

On termination of the irrigation cycle, the retract spring 100 moves the sprinkler 12 and stem 46 downwardly into the casing 14. As the sprinkler 12 retracts, the cover 74 will engage the upper end of the sleeve 114 and, since the retract spring 100 is designed to act with greater force than the pop-up springs 124, will cause the sleeve to retract together with the sprinkler into the casing to the inoperative position shown in FIG. 2. Thus, during retraction, after the cover 74 engages the sleeve 114, the sprinkler 12 is again fully encased during movement into the casing 14, thereby preventing dirt, grit, and other deleterious particulate matter from entering into the casing.

Thus, the present invention provides a pop-up shield or guard 10 for use with a pop-up irrigation sprinkler 12 to reliably and effectively prevent dirt, grit, sand, grass, weeds and other deleterious particulate matter from entering the sprinkler casing 14 during sprinkler operation. Moreover, the pop-up guard 10 is relatively simple in design and inexpensive to manufacture, and significantly enhances overall sprinkler reliability and operation, particularly in sandy and gravel-concentrated soils.

While a particular form of the invention has been illustrated and described, a variety of modifications and changes can be made without departing from the spirit and scope of the invention.

We claim:

1. In a pop-up irrigation sprinkler of the type including a casing adapted to be buried in the ground having an open upper end and a generally closed bottom, a sprinkler coupled to a stem and mounted to said casing for relative movement between an extended, operative position with the sprinkler elevated above the casing and a retracted, inoperative position with the sprinkler housed within the casing below the open end, and a cover overlying the sprinkler and adapted to close the open end of the casing when the sprinkler is in the retracted, inoperative position, the improvement comprising:

pop-up shield means coupled to said casing and movable with said sprinkler between a fully extended and a retracted position during a portion of said sprinkler extension and retraction, said cover engaging said shield means during movement of said shield means between said fully extended and retracted positions of said shield means thereby to effectively encase said sprinkler during said portion of said sprinkler extension and retraction.

2. The improvement as set forth in claim 1 wherein said pop-up shield means includes a cylinder sleeve having an open upper end and surrounding said sprinkler, said sleeve being disposed within said casing when said sprinkler is in said retracted, inoperative position.

3. The improvement as set forth in claim 2 wherein said sleeve is biased toward said extended position.

4. The improvement as set forth in claim 3 wherein said cover engages said open upper end of said sleeve during said portion of sprinkler extension and retraction.

5. The improvement as set forth in claim 4 further including a seal of open-cell foam material disposed between said sleeve and said casing.

6. The improvement as set forth in claim 1 including a seal of open-cell foam material disposed between said shield and said casing.

7. A pop-up irrigation sprinkler comprising:

a casing having an open upper end and a substantially closed bottom;

a pop-up sprinkler assembly mounted to said casing for movement between an extended, operative position and a retracted, inoperative position, said assembly including a sprinkler head attached to the upper end of a tubular stem, said stem being movably mounted within said casing for extending said head above said upper end of said casing to said operative position and for retracting said head into said casing to said inoperative position;

means biasing said sprinkler assembly toward said retracted position;

a cover coupled to said sprinkler assembly and overlying said head; and a pop-up shield slidably mounted to said casing and movable between a fully extended position and a retracted position, said shield surrounding said head when in its retracted position and being movable with said pop-up sprinkler assembly during a portion of said extension and retraction of said pop-up sprinkler assembly, said shield having an upper end engageable with said cover during movement of said shield between said fully extended and retracted positions of said shield thereby to effectively encase said pop-up sprinkler assembly during said portion of said extension and retraction of said pop-up sprinkler assembly.

8. A pop-up sprinkler as set forth in claim 7 wherein said pop-up shield is a cylindrical sleeve.

9. A pop-up sprinkler as set forth in claim 8 wherein said sleeve is biased toward its extended position.

10. A pop-up sprinkler as set forth in claim 7 wherein said sprinkler head is an impact-drive type sprinkler.

11. A pop-up sprinkler as set forth in claim 10 wherein said pop-up shield is a cylindrical sleeve, and includes means for biasing said sleeve toward its extended position.

12. A pop-up sprinkler as set forth in claim 11 including a seal of open-cell foam material disposed between said sleeve and said casing.

13. A pop-up sprinkler as set forth in claim 7 including a seal of open-cell foam material disposed between said shield and said casing.

* * * * *